United States Patent [19]

Schwartzman et al.

[11] Patent Number: 4,569,612

[45] Date of Patent: Feb. 11, 1986

[54] LIQUID APPLICATOR AND VALVE THEREFOR

[76] Inventors: Gilbert Schwartzman, 1025 Old W.P. Rd., Mamaroneck, N.Y. 10543; Sally Q. Buschemeyer, 254 Ridgeway Ct., Louisville, Ky. 40207

[21] Appl. No.: 599,738

[22] Filed: Apr. 12, 1984

[51] Int. Cl.[4] ..... A47L 13/17; A46B 11/00

[52] U.S. Cl. ..... 401/206; 401/152; 401/273

[58] Field of Search ..... 401/206, 157, 152, 273; 137/543.23; 251/339; 119/72.5, 75

[56] References Cited

U.S. PATENT DOCUMENTS

| | | | |
|---|---|---|---|
| 2,204,778 | 6/1940 | Sturm | 401/152 |
| 2,579,167 | 12/1951 | Atkinson | 401/273 X |
| 2,643,409 | 6/1953 | Hempel et al. | 401/206 |
| 2,790,984 | 5/1957 | Gilpin | 401/206 X |
| 3,135,988 | 6/1964 | Schwartzman | 401/206 |
| 3,135,988 | 6/1964 | Schwartzman | 15/566 |
| 3,192,553 | 7/1965 | Schwartzman | 401/206 |
| 3,233,594 | 2/1966 | Zepell | 401/157 |
| 3,256,551 | 6/1966 | Schwartzman | 15/569 |
| 3,349,966 | 10/1967 | Schwartzman | 222/80 |
| 3,481,678 | 12/1969 | Schwartzman | 401/206 |
| 3,545,874 | 12/1970 | Schwartzman | 401/186 |
| 3,549,269 | 12/1970 | Schwartzman | 401/206 |
| 3,565,294 | 2/1971 | Schwartzman | 222/107 |
| 3,661,468 | 5/1972 | Schwartzman | 401/206 |

FOREIGN PATENT DOCUMENTS

| | | | |
|---|---|---|---|
| 1492050 | 7/1967 | France | 401/206 |

*Primary Examiner*—Steven A. Bratlie

*Attorney, Agent, or Firm*—Jon C. Winger

[57] ABSTRACT

A liquid applicator includes a generally cylindrical container having an open neck end. A flexible bag adapted to hold a liquid to be applied is disposed within the container with the open mouth of the bag located within the open neck of the container. A valve assembly is situated in the open neck of the container to control the flow of liquid from the bag through the open container neck. A dauber tip of porous material is located at the exterior of the open container neck for receiving liquid flowing through the valve assembly and applying the liquid to an object.

15 Claims, 5 Drawing Figures

LIQUID APPLICATOR AND VALVE THEREFOR

BACKGROUND OF THE INVENTION

The present invention relates to liquid applicators, and more particularly to a liquid applicator wherein the flow of liquid therefrom is controlled by a valve.

Various liquid applicators having a valve for controlling liquid flow are known. by way of example, some of the heretofore known valve controlled applicators are shown in U.S. Pat. No. 3,256,551; U.S. Pat. No. 3,349,966; U.S. Pat. No. 3,481,678; U.S. Pat. No. 3,545,874; and U.S. Pat. No. 3,565,294.

It is an object of the present invention to provide a liquid applicator adapted to smoothly apply a liquid to an object even when the applicator is held an an acute angle to the object.

It is another object of the present invention to provide a liquid applicator which is spill proof.

It is yet another object of the present invention to provide a liquid applicator having a convex dauber tip.

It is still another object of the present invention to provide a liquid applicator which facilitates easy assembly of the various components thereof.

SUMMARY OF THE INVENTION

The present invention provides a liquid applicator which satisfies these objectives, and more particularly a liquid applicator comprising a container having an open neck at one end, a bag for containing a liquid to be applied located within the container with the open bag mouth sized and configured to smoothly fit into the open container neck against the interior wall surface of the open container neck, a valve assembly for controlling liquid flow from the bag through the open container neck, the valve assembly being located within the open container neck capturing the bag mouth between the valve assembly and the interior wall surface of the open container neck, a porous dauber tip affixed to the valve assembly, the dauber tip having a convex contour, and a ventilation aperture formed through the wall of the container providing for atmospheric pressure interior of the container surrounding the bag.

BRIEF DESCRIPTION OF THE DRAWINGS

The various objectives and features of the present invention will become even more clear upon reference to the following discussion in conjunction with the accompanying drawings wherein like numberals refer to like parts throughout the several figures and in which.

DESCRIPTION OF THE PREFERRED EMBODIMENT

Figure 1:
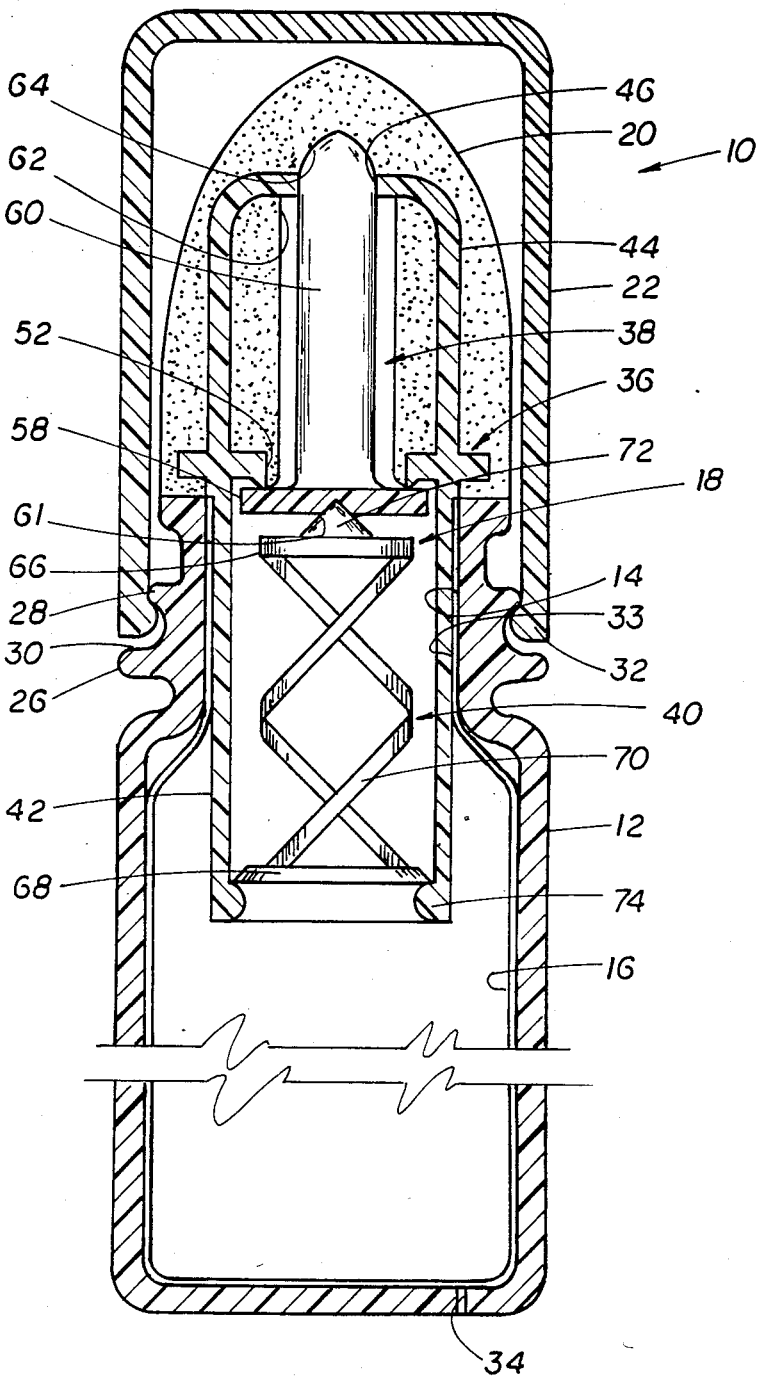
FIG. 1 is a longitudinal cross-sectional view of a liquid applicator including the features of the present invention.
Figure 2:
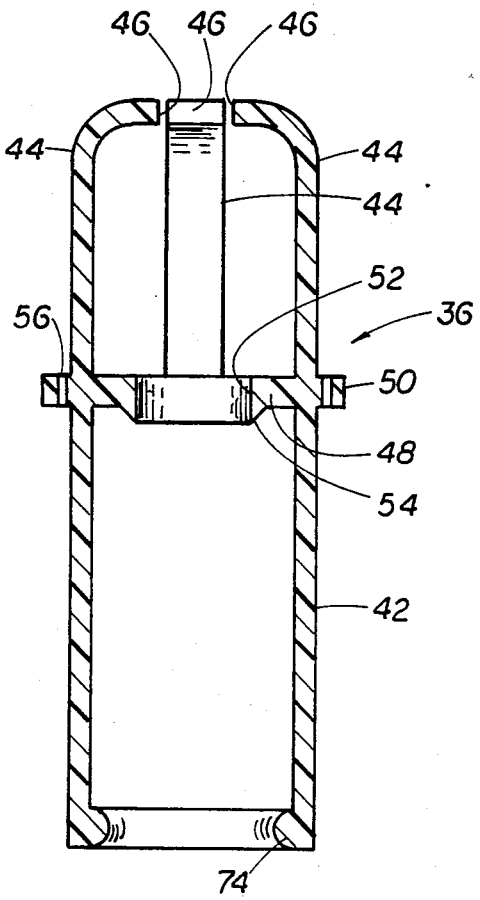
FIG. 2 is a longitudinal cross-sectional view of a component of the valve assembly of the applicator of FIG. 1.

With reference to FIG. 1, there is shown a liquid applicator, generally denoted as the numeral 10. The applicator 10 includes a generally cylindrically shaped hollow container 12 having one open neck end 14, and enclosing a bladder or bag 16. The applicator 10 further includes a valve assembly 18 located in the open neck end 14 of the container in liquid flow communication with the interior of the bag 16, and a porous dauber tip 20 disposed over the end of the valve assembly 18 at the open neck end 14 of the container 12. The porous tip 20 is selectively covered by a removable cap 22 having a circumferential bottom edge defining the bottom open end of the cap 22.

With continued reference to FIG. 1, the exterior surface of the open neck end 14 of the hollow container 12 is formed with two spaced apart circumferential flanges 26 and 28. The bottom most circumferential bottom flange 26 is adapted to abut the circumferential edge of the cap 22 and functions as a stop for the cap 22 so that it can not be jammed down against the porous tip. The uppermost flange 28 cooperates with the bottom-most flange 26 to define an annular groove 30. The cap 22 is formed with an inwardly projecting circumferential bead 32 at the open end thereof. The cap 22 is adapted to be disposed over the tip 20 and removably fastened in place by pushing the cap 22 downwardly until the circumferential bead 32 snaps over the uppermost flange 28 and seats in the annular groove 30.

The bag 16 fabricated of a flexible material, for example, a plastic such as polyethylene or the like. The open mouth 33 of the bag 16 is sized and configured to smoothly fit into and against the interior wall surface of the open container neck 14 with the body of the bag 16 sized and configured to substantially fill the hollow interior of the container 12. The bag 16 is adapted to be the reservoir for the liquid to be applied by the liquid applicator 10. In order to prevent a vacuum from being created within the container 12 which could prevent or inhibit the flow of liquid from the bag 16 through the open bag mouth, a ventilation aperture 34 is formed through a wall of the container 12 so that the interior of the container 12 surrounding the bag 16 is atmospheric pressure.

Now with reference to FIGS. 1 through 5, the valve assembly 18 comprises a valve housing, generally denoted as the numeral 36, enclosing a valve 38, and a valve spring 40. The valve housing 36 includes a depending ring 42 and a plurality flexible fingers 44 spaced apart about and extending upwardly from the top marginal edge of the depending ring 42. The depending ring 42 conforms in transverse cross-sectional size and shape to the interior wall of the open container neck 14, and is adapted to coaxially fit into the container neck 14 with a press fit capturing the open mouth of the bag between the outer surface of the valve housing ring 42 and interior wall surface of the bottle neck 14. The fingers 44 converge toward their distal ends to form an open basket-like structure approximating the contour of the dauber tip 20. Further, the convergent distal ends of the fingers 44 define an opening 46 coaxial with the depending ring 42. Proximate the interface of the fingers 44 and depending ring 42, there is located an inwardly projecting circumferential flange 48, and an outwardly projecting circumferential flange 50. The inwardly projecting flange 48 defines a central valve stem opening 52 coaxial with the aperture 46 at the distal ends of the fingers 44. The inwardly projecting flange 48 includes a circular lip 54 coaxial with the valve stem aperture 52 and extending downwardly from the bottom side of the inwardly projecting flange 48 toward and coaxial with the valve housing depending ring 42. The circular lip 54 defines a valve seat. The outwardly projecting circumferential flange 50 forms an anchoring flange for the dauber tip 20. The upper surface of the outwardly projecting flange 50 is formed with a plurality of spaced apart holes 56 in a circular array about the flange 50 which function to further secure the tip 20 in place.

Figure 3:
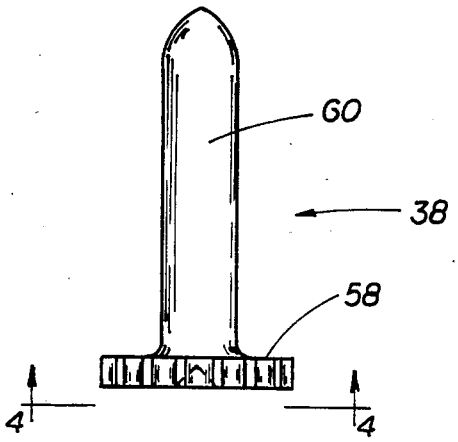
FIG. 3 is a side view of another component of the valve assembly of the applicator of FIG. 1.
Figure 4:
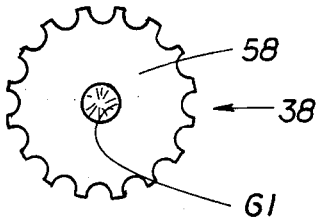
FIG. 4 is a bottom view of the component of FIG. 3.

With reference to FIGS. 1, 3 and 4, the valve 38 comprises a generally circular valve head 58 and an integrally formed valve stem 60 projecting coaxially from the top side of the valve head 58. The valve head 58 is of larger diameter than the diameter of the valve seat lip 54, and its perimeter is formed with serrations which provide selected liquid flow through paths for the liquid. The valve seat lip 54 is adapted to sealingly contact the top side of valve head 58 radially inwardly of the serrations. In addition, the bottom side of the valve head 58 is formed with a small centrally located pivot cavity 61. As shown, the cavity 61 is generally conically shaped. The valve stem 60 is longer than the distance between the valve stem aperture 52 and the opening 46 at the distal ends of the fingers 44 measured coaxially of the valve stem aperture 52 and opening 46. The valve 38 is positioned within the valve housing 36 with the top side of the valve head 58 positioned adjacent the bottom side of the valve seat lip 54 and the valve stem projecting upwardly through the valve stem 60 aperture 52 of the inwardly projecting circumferential flange 48 and through the opening 46 at the distal ends of the fingers 44.

With reference to FIG. 1, the dauber tip 20 is fabricated of a porous material, for example, polyurethane. The tip 20 is coaxially located over the basket-like structure defined by the fingers 44 and the outwardly projecting circumferential flange 50. More particularly, as shown, the fingers 44 and the outwardly projecting flange 50 are embedded with the material of the tip 20. Toward this end, the tip 20 can be molded in place. The outer contour of the tip 20 is convex, and preferably has a rather sharp pointed contour such as a bullet. The tip 20 is formed with a blind ended void 62 coaxial with the valve stem aperture 52 of the flange 48 and open to the valve stem receiving aperture 52 while the blind end of the void 62 is formed with a small pocket 64 coaxial with the opening 46 at the distal ends of the fingers 44. The void 62 is larger in transverse cross-sectional area than the transverse cross-sectional area of the valve stem 60, and the dimensions and configuration of the pocket 64 generally conform to the dimension and configuration of the free end of the valve stem 60. The valve stem 60 is generally concentrically located within the void 62 with its free end disposed in the pocket 64 at the blind end of the void 62.

Figure 5:
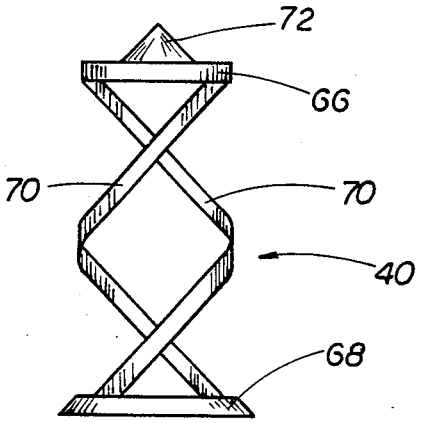
FIG. 5 is a side view of a further component of the valve assembly of the applicator of FIG. 1.

With reference to FIGS. 1 and 5, the valve spring 40 is shown as comprising a valve head contact plate 66 at one end, a valve spring retainer ring 68 at the other end, and at least one helical coil 70 integrally formed at its opposite end with the contact plate 66 and retainer ring 68, respectively. The valve head contact plate 66 is generally circular in shape and is of a smaller diameter than the valve head 58. Further, the valve head contact plate 66 has a pivot point structure 72 projecting upwardly from and coaxial with the top side of the head contact plate 66. The pivot point 72 is sized and configured to fit into the pivot cavity 61 in the bottom side of the valve head 58. The pivot point structure 72 and pivot cavity 61 cooperate to define pivot means allowing the valve 38 to pivot with respect to the valve spring 40. The valve spring 40 is located concentrically within the depending ring 42 of the valve housing 36 with the valve head contact plate 66 adjacent the bottom side of the valve head 58 and the pivot point 72 located in the pivot cavity 61. The valve spring 40 is retained in the depending ring 42, under compression, by the bottom swaged end 74 of the depending ring 42 in contact with the valve spring retainer ring 68. Therefore, the helical coil 70 biases the valve head contact plate 66 against the valve head 58 which forces the valve head 58 in sealing contact with the valve seat lip 54 of the valve seat flange 48 closing the valve stem aperture 52 preventing liquid from flowing from the bag 16 into the void 62 of the tip 20.

In use, after the cap 22 has been removed from its position over the tip 20, the dauber tip 20 is placed against an object upon with the liquid is to be applied with enough force to even slightly compress the tip 20. The compression of the tip 20 causes the pocket 64 at the blind end of the void 62 to pivot or rock the stem 60 of the valve 38 about the pivot point 72 of the valve head contact plate 66, thus, moving a portion of the valve head 58 away from the valve seat lip 54 against the biasing force of the valve spring 40. When this occurs, liquid is allowed to flow from the bag past the portion of the serrated peripheral edge of the valve head 58 lifted from the sealing lip 54, and into the void 62 in the porous dauber tip 20. The liquid passes from the void into and through the porous tip material to the outer surface of the tip 20 whereat the liquid is applied to the object. When the tip 20 is removed from the object to which the liquid has been applied, the resilient fingers 44, in conjunction with the force exerted by the valve spring 40, moves the valve stem 60 back to center within the void 62 about the pivot point 72, and the helical coil 70 forces the valve head 58 back into total contact with the valve seat lip 54.

The foregoing detailed description is given primarily for clearness of understanding and no unnecessary limitations are to be understood therefrom for modifications will become obvious to those skilled in the art upon reading this disclosure and may be made without departing from the spirit if the invention and scope of the appended claims.

What is claimed is:

1. A liquid applicator comprising:

a container having an open neck at one end;

a bag for containing a liquid to be applied located within the container, the bag having an open mouth sized and configured to smoothly fit into the open container neck against the interior wall surface of the open container neck;

a valve assembly for controlling liquid flow from the bag through the open container neck, the valve assembly being located within the open container neck capturing the bag mouth between the valve assembly and the interior wall surface of the open container neck, the valve assembly comprising a valve housing comprising a depending ring having a transverse cross-section size and configuration generally corresponding to the transverse cross-sectional size and configuration of the open container neck, and a plurality of flexible fingers projecting upwardly from the top end of the depending ring, the distal ends of the fingers converging defining an opening between the distal ends, and a valve disposed within the valve housing for controlling liquid flow through the valve housing, the valve comprising a valve stem projecting upwardly between the converging distal ends of the fingers;

a porous dauber tip having a convex contour, the fingers of the valve housing being embedded within the material of the porous tip affixing the dauber tip to the valve housing; and, a ventilation aperture formed through the wall of the container providing for atmospheric pressure interior of the container surrounding the bag.

2. The liquid Applicator of claim 1, wherein the material of the tip defines a blind-ended void within the tip concentric with the valve stem.

3. The liquid applicator of claim 1, wherein the valve assembly further comprises means for biasing the valve to a closed position.

4. The liquid applicator of claim 1, wherein:

(a) the valve housing comprises:

an inwardly projecting circumferential flange defining a valve stem aperture coaxial with the opening at the distal ends of the fingers; and, an outwardly projecting circular flange embedded within the material of the porous dauber tip;

(b) the valve comprises:

a generally circular valve head adapted to close the valve stem aperture from the bottom side of the inwardly projecting circumferential flange; and, the valve stem projects coaxially upwardly from the valve head through the valve stem aperture.

5. The liquid applicator of claim 4, further comprising a circular lip coaxial with the valve stem aperture and extending downwardly from the bottom side of the inwardly projecting flange of the valve housing, the valve head being adapted to sealingly contact the circular lip when the valve is in the closed position.

6. The liquid applicator of claim 5 further comprising means for biasing the valve to a closed position with the valve head in sealing contact against the circular lip of the inwardly projecting circumferential flange of the valve housing.

7. The liquid applicator of claim 6, further comprising pivot means interconnecting the valve and the biasing means for allowing the valve to pivot with respect to the biasing means.

8. The liquid applicator of claim 7, wherein the valve biasing means comprises:

a valve head contact plate at one end;

a valve spring retainer ring at the other end; and, at least one helical coil associated at its opposite ends with the valve head contact plate and with the valve spring retainer ring, respectively;

the valve biasing means being located within depending ring of the valve housing with the valve contact plate adjacent the bottom side of the valve head of the valve.

9. The liquid applicator of claim 8, wherein the pivot means comprises:

(a) the valve head is formed with a pivot cavity centrally located in the bottom side of the valve head; and, (b) a pivot point structure projecting upwardly from and coaxial with the top side of the valve head contact plate of the valve biasing means, the pivot point structure being sized and configured to fit into the pivot cavity of the valve head.

10. The liquid applicator of claim 4, wherein the perimeter of the valve head is serrated.

11. The liquid applicator of claim 4, wherein the material of the tip defines a blind-ended void within the tip concentric with the valve stem and open to the valve stem aperture of the inwardly projecting circumferential flange.

12. The liquid applicator of claim 11, wherein the material of the tip further defines a pocket at the blind-end of the void, and the free end of the valve stem projecting between the diverging distal ends of the fingers is disposed within the pocket.

13. A valve assembly comprising:

a valve housing comprising a depending ring, and a plurality of flexible fingers projecting from the top end of the ring, the distal ends of the fingers converging, and an inwardly projecting circumferential flange defining a valve stem aperture coaxial with the opening defined by the distal ends of the fingers;

a valve disposed within the valve housing comprising a generally circular valve head adapted to close the valve stem aperture from the bottom side of the inwardly projecting circumferential flange, and a valve stem projecting upwardly from the top side of the valve head coaxially through the valve stem aperture, and coaxially through the opening defined by the distal ends of the fingers;

biasing means disposed within the depending ring for biasing the valve head against the bottom side of the inwardly projecting circular flange closing the valve stem aperture; and, pivot means interconnecting the valve and the biasing means for allowing the valve to pivot with respect to the biasing means.

14. The valve assembly of claim 13, wherein the pivot means comprises:

means defining a pivot cavity in the valve head; and, pivot point structure means associated with the biasing means, the pivot point structure being sized and configured to fit into the pivot cavity.

15. The valve assembly of claim 13, wherein the perimeter of the valve head is serrated.

* * * * *